US007516955B2

(12) United States Patent
Yamagishi

(10) Patent No.: US 7,516,955 B2
(45) **Date of Patent: *Apr. 14, 2009**

(54) PAPER FEED TRAY, PAPER FEEDING APPARATUS, AND IMAGE FORMING APPARATUS INCLUDING PAPER ALIGNING UNITS

(75) Inventor: Masaru Yamagishi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 424 days.

This patent is subject to a terminal disclaimer.

(21) Appl. No.: 11/203,344

(22) Filed: Aug. 15, 2005

(65) Prior Publication Data

US 2006/0087073 A1 Apr. 27, 2006

(30) Foreign Application Priority Data

Oct. 21, 2004 (JP) ..... 2004-307052

(51) Int. Cl.
*B65H 1/00* (2006.01)

(52) U.S. Cl. ..... 271/171; 399/393

(58) Field of Classification Search ..... 271/171; 399/393

See application file for complete search history.

(56) References Cited

U.S. PATENT DOCUMENTS 5,172,903 A * 12/1992 Haneda et al. ..... 271/171
5,327,206 A * 7/1994 Ueda et al. ..... 399/402
5,509,647 A 4/1996 Iwanaga
5,647,585 A * 7/1997 Cheong ..... 271/171
5,737,682 A 4/1998 Yamagishi
6,014,229 A * 1/2000 Yun ..... 358/449
6,073,925 A * 6/2000 Sato ..... 271/171
6,254,085 B1 * 7/2001 Kang ..... 271/171
6,279,900 B1 8/2001 Yamagishi
6,393,252 B1 5/2002 Yamagishi
6,523,822 B1 * 2/2003 Galtier et al. ..... 271/171
6,530,569 B2 3/2003 Yamagishi
6,543,761 B2 * 4/2003 Endo ..... 271/110
6,557,757 B1 * 5/2003 Peebles ..... 235/379
6,688,592 B1 * 2/2004 Tan et al. ..... 271/171
6,690,911 B2 2/2004 Yamagishi
6,711,377 B2 3/2004 Yamagishi
7,144,007 B2 * 12/2006 Kim ..... 271/171
2005/0196211 A1 * 9/2005 Miki ..... 399/389

(Continued)

FOREIGN PATENT DOCUMENTS

EP 1 571 107 A1 9/2005

(Continued)

*Primary Examiner*—Patrick Mackey
*Assistant Examiner*—Gerald W McClain
(74) *Attorney, Agent, or Firm*—Oblon, Spivak, McClelland, Maier & Neustadt, P.C.

(57) ABSTRACT

A tray unit can accommodate a stack of recording mediums. A side fence performs alignment of the stack of the recording mediums in one direction and an end fence performs alignment in another direction. A first lever has a first corrugated portion and it pivots with the tray unit according to sliding motion of the side fence. A second lever has a second corrugated portion and it pivots with the tray unit according to sliding motion of the end fence. A sensor is provided integrally with the tray unit and has portions that are selectively pressed by a composite corrugated portion formed of the first corrugated portion and the second corrugated portion.

8 Claims, 9 Drawing Sheets

U.S. PATENT DOCUMENTS

2006/0087072 A1 * 4/2006 Kwon et al. ..... 271/171

FOREIGN PATENT DOCUMENTS

JP 59227630 A * 12/1984
JP 1-214530 8/1989
JP 8-119462 5/1996
JP 2000-118729 4/2000
JP 2002-187626 7/2002

* cited by examiner

| DESTINATION | PAPER SIZE | A | B | C | D | E |
|---|---|---|---|---|---|---|
| <DOM> | A3 | 0 | 1 | 1 | 0 | 1 |
| | B4 | 1 | 1 | 1 | 0 | 0 |
| | A4T | 1 | 1 | 1 | 0 | 1 |
| | A4Y | 0 | 0 | 1 | 0 | 1 |
| | B5T | 1 | 0 | 0 | 0 | 0 |
| | B5Y | 0 | 1 | 1 | 0 | 0 |
| | A5T | 0 | 0 | 0 | 1 | 1 |
| | A5Y | 1 | 1 | 0 | 0 | 1 |
| <NA> | DLT (11" × 17") | 1 | 0 | 1 | 0 | 1 |
| | LG (8.5" × 14") | 1 | 1 | 0 | 1 | 0 |
| | LTT (8.5" × 11") | 1 | 0 | 0 | 1 | 1 |
| | LTY | 1 | 0 | 0 | 0 | 1 |
| | HLTT | 0 | 0 | 0 | 0 | 1 |
| | HLTY | 1 | 0 | 0 | 1 | 0 |
| | F4 (8.5" × 13") | 1 | 1 | 0 | 1 | 1 |
| | Folio (8.25" × 13") | 0 | 1 | 0 | 1 | 1 |
| <EU/ASIA> | A3 | 0 | 1 | 1 | 0 | 1 |
| | A4T | 1 | 1 | 1 | 0 | 1 |
| | A4Y | 0 | 0 | 1 | 0 | 1 |
| | A5T | 0 | 0 | 0 | 1 | 1 |
| | A5Y | 1 | 1 | 0 | 0 | 1 |
| | F4 (8.5" × 13") | 1 | 1 | 0 | 1 | 1 |
| | Folio (8.25" × 13") | 0 | 1 | 0 | 1 | 1 |

PAPER FEED TRAY, PAPER FEEDING APPARATUS, AND IMAGE FORMING APPARATUS INCLUDING PAPER ALIGNING UNITS

CROSS-REFERENCE TO RELATED APPLICATIONS

The present document incorporates by reference the entire contents of Japanese priority document, 2004-307052 filed in Japan on Oct. 21, 2004.

BACKGROUND OF THE INVENTION

1. Field of the Invention

The present invention relates to a paper feed tray of an image forming apparatus.

2. Description of the Related Art

Copying machines, facsimiles, printers, and the like are example of an image forming apparatus. In some image forming apparatuses, size of a paper on which an image is to be formed can be selected. The selection is performed automatically according to the size of a document or performed manually.

In some image forming apparatuses, a paper feed tray is provided corresponding to each paper size. In some other image forming apparatuses, one paper feed tray that can accommodate papers of various sizes is provided.

In the later paper feed tray, a side fence is provided and a user slides the side fence until the fences abuts against side edge of the paper stacked in the paper feed tray. However, sometimes the user forgets to slide the side fence. If the side fence does not abut against the side edge of the paper, it may leads to paper jamming.

Japanese Patent Application Laid-Open Nos. 2002-187626 and 2000-118729 discloses a solution to the above problem.

SUMMARY OF THE INVENTION

It is an object of the present invention to at least solve the problems in the conventional technology.

A paper feed tray according to one aspect of the present invention includes a tray unit configured to accommodate a stack of recording mediums; a first aligning unit slidable in a first direction and that is configured to perform an alignment of the stack of the recording mediums in the tray unit in the first direction; a second aligning unit slidable in a second direction that is orthogonal to the first direction and that is configured to perform an alignment of the stack of the recording media in the tray unit in the second direction; a first movable member including a first corrugated portion, and configured to pivot with the tray unit according to sliding motion of the first aligning unit; a second movable member including a second corrugated portion, and configured to pivot with the tray unit according to sliding motion of the second aligning unit; and a detecting unit that has a plurality of pressed portions which are selectively pressed by a composite corrugated portion formed of the first corrugated portion and the second corrugated portion, and that is provided integrally with the tray unit.

A paper feeding apparatus according to another aspect of the present invention includes a paper feed tray according to the present invention.

An image forming apparatus according to still another aspect of the present invention includes a paper feeding apparatus according to the present invention.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below with reference to the accompanying drawings.

Figure 14:
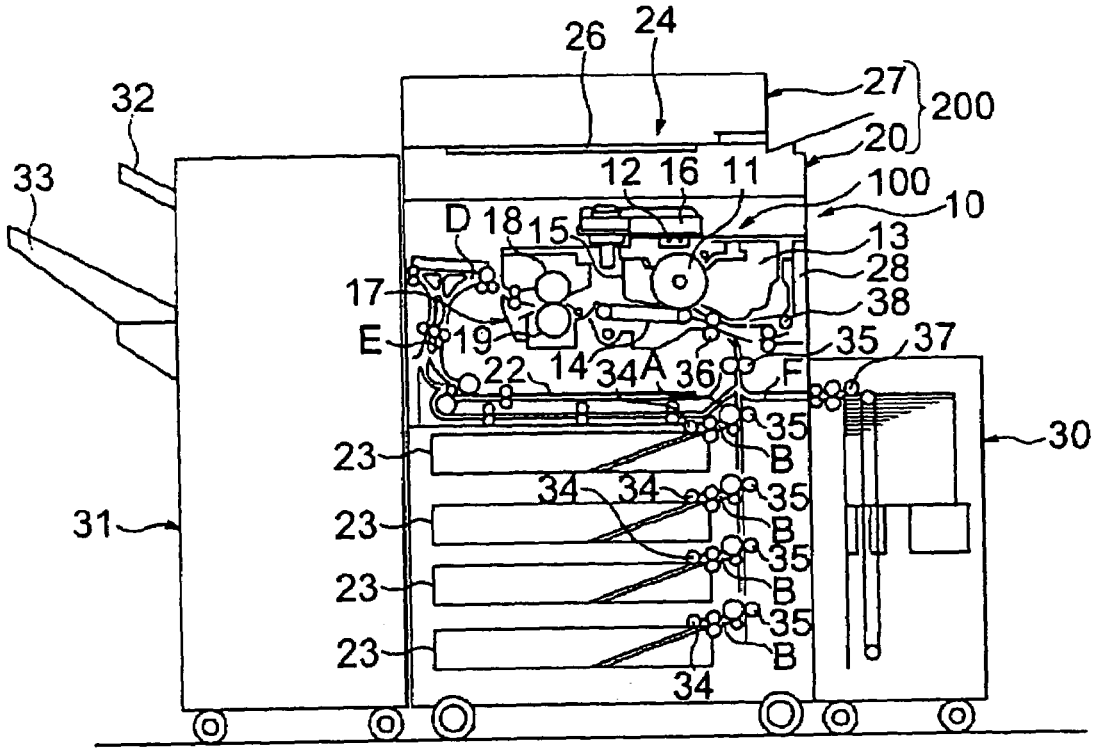
FIG. 14 is a schematic configuration diagram of a copying machine as one example of an image forming apparatus.

A copying machine according to an embodiment of the present invention is shown in FIG. 14. This copying machine includes a copying machine main unit 10. The copying machine main unit 10 includes a laser writing device 16, an image forming unit 100, a two-sided unit 22, and four-tiered paper feed trays 23 copying machine main unit 10.

The image forming unit 100 includes a drum-like photoconductor 11 serving as an image carrier, a charging device 12, a developing device 13, a transferring and conveying device 14, and a cleaning device 15 that are disposed around the photoconductor 11, and the like.

The laser writing device 16 emits laser beam to the photoconductor 11 according to image data to expose and scan on a surface of the photoconductor 11. The laser writing device 16 includes a light source, a scanning optical system, a polygon motor, an fθ lens, and mirrors, and the like (not shown). The light source can be a laser diode. The scanning optical system can be a rotary polygon mirror.

A fusing device 17 is provided on a left side of the cleaning device 15 shown in FIG. 14. The fusing device 17 includes a fusing roller 18 incorporated with a heater and a pressurizing roller 19 pushed against the fusing roller 18 from beneath.

Each paper feed tray 23 accommodates sheet-like recording material in a stacked manner. The recording material can be paper or over head projector (OHP) sheets. A paper refeeding path A from the two-sided unit 22 and a feeding path B from each paper feed tray 23 respectively communicates with a common paper feeding path C extending below the photoconductor 11. The two-sided unit 22 forms a reversing path E branched at a midway of a paper discharging path D extending from an outlet of the fusing device 17.

A contact glass 26 is disposed at an image reader 24 positioned on an upper face of the copying machine main unit 10. An optical reading device 20 that optically reads an image on a document is positioned below the contact glass 26. An automatic document conveying device 27 that conveys documents onto the contact glass 26 one by one is openably/closably provided on the copying machine main unit 10 so as to cover the contact glass 26. The automatic document conveying device 27 and the optical reading device 20 constitute the image reading device 200.

A manual tray 28 that guides a manually-set paper to the paper feeding path C is externally and openably/closably provided on a right side face of the copying machine main unit 10. A large capacity paper feeding device 30 is disposed on the copying machine main unit 10. The large capacity paper feeding device 30 accommodates a large number of stacked sheets of paper that can be ascended and descended therein.

A post-processing device 31 is externally disposed on the copying machine main unit 10 on the left side face of the copying machine main unit 10. The post-processing device 31 receives the paper discharged via the paper discharging path D and discharges the paper onto an upper tray 32 as it is or discharge the paper to the upper tray 32 or a lower tray 33 after a post-processing such as stapling or punching.

When copying is performed using the copying machine, the user sets a document on the automatic document conveying device 27 or opens the automatic document conveying device 27 to directly set a document on the contact glass 26. When the user presses a start button (not shown), the automatic document conveying device 27 is driven and the image reader 24 reads the document conveyed to the contact glass 26 of the image reader 24 to discharge the document to a document discharge tray (not shown). When the user preliminarily sets a document on the contact glass 26, the document reader 24 reads image data on the set document. The read image data is transmitted to the laser writing device 16.

In parallel with the above operation, a paper feeding roller 34 for the paper feed tray 23 that accommodates paper corresponding to a developing size or a magnification size starts rotating to pick up a piece of paper. The picked-up paper is conveyed from the paper feeding path B into the paper feeding path C and is stopped at a position where a leading edge of the paper abuts on a registration roller 36 by a conveying roller 35. In exact timing with rotation of a leading position for image writing on the photoconductor 11, the registration roller 36 is rotated and the paper is fed in below the photoconductor 11 of the image forming unit 100.

The paper can be fed from the large capacity paper feeding device 30 by rotationally driving the paper feeding roller 37. In this case, paper is inserted into the paper feeding path C through a paper conveying path F and conveyed by the conveying roller 35 to be caused to abut on the registration roller 36 to be stopped. Similarly, paper manually set on the opened manual tray 28 is inserted into the paper feeding path C by rotating the paper feeding roller 38 for the manual tray 28 to be caused to abut on the registration roller 36 to be stopped. The registration roller 36 is rotated in exact timing with rotation of the photoconductor 11 and the paper is fed in below the photoconductor 11 of the image forming unit 100.

On the other hand, the photoconductor 11 of the image forming unit 100 is rotated in a clockwise direction in FIG. 14 by pressing a start switch (not shown). First, a surface of the photoconductor 11 is uniformly charged according to rotation of the photoconductor 11 by the charging device 12 and the laser writing device 16 then performs optical writing on the surface of the photoconductor 11 based on the image data read by the optical reading device 20 to form an electrostatic latent image on the surface of the photoconductor 11. The electrostatic latent image is toner-developed by the developing device 13 to constitute a visualized toner image.

Paper is fed from the registration roller 36 in exact timing with a leading edge of the toner image (the written image) and the toner image is transferred onto the paper in the transferring and conveying device 14. The photoconductor 11 after image transfer is cleaned by the cleaning device 15 and residual toner is removed therefrom to prepare for the next image formation. The photoconductor 11, the transferring and conveying device 14, and the cleaning device 15 constitute a unit (a process cartridge). The paper transferred with the image is conveyed to the fusing device 17 by the transferring and conveying device 14, where a transferred image is fused by applying heat and pressure on the paper by the fusing roller 18 and the pressurizing roller 19. Thereafter, the paper with the fused image is discharged to the sheet post-processing device 31 via the paper discharging path D.

When images are formed on both sides of paper, the paper is conveyed to the reversing path E from the midway of the paper discharging path D and reversed at the two-sided unit 22 to be re-fed to the transferring and conveying device 14, where an image formed on the photoconductor 11 separately with the first image is transferred on a backside of the paper. The transferred image is fused by the fusing device 17 and the paper with the fused image is discharged to the sheet post-processing device 31.

Figure 3:
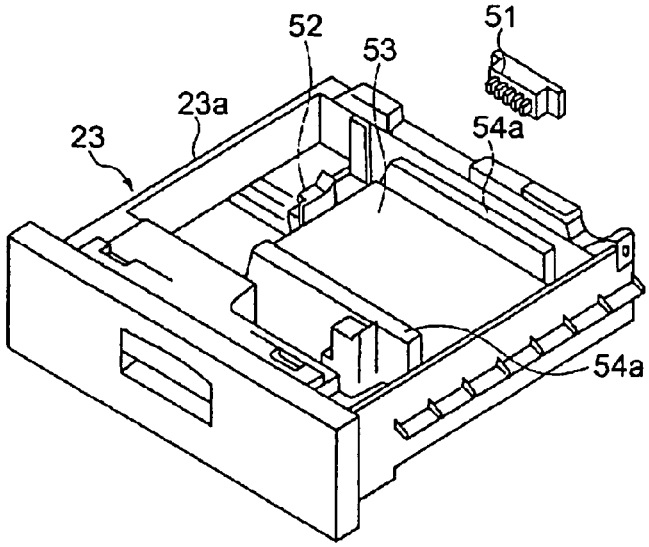
FIG. 3 is a perspective view of the paper feed tray and a detecting sensor in a basic configuration of the present invention.
Figure 5:
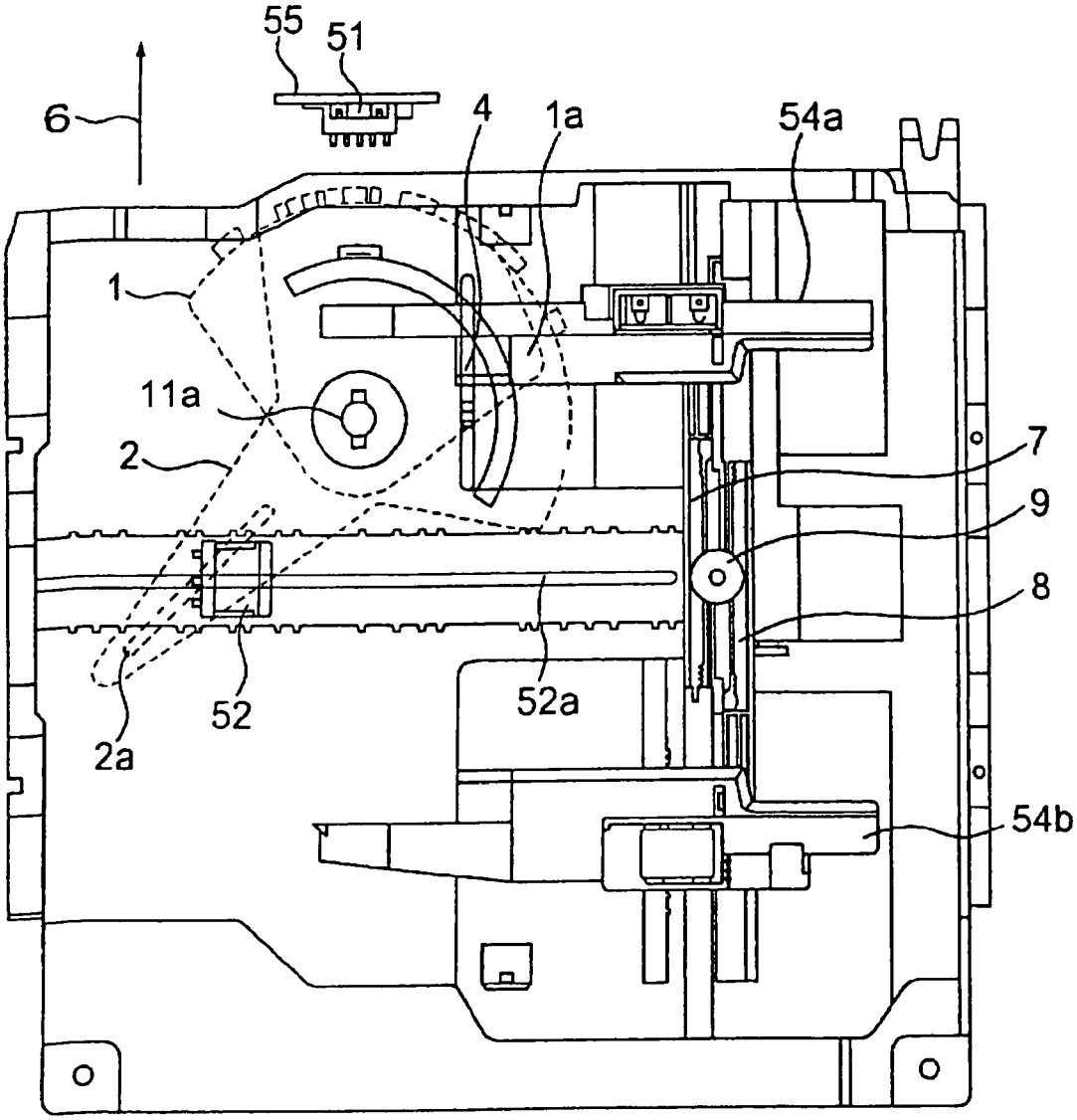
FIG. 5 is a plan view of a sliding mechanism between the paper feed tray positioned just before the loading position inside the copying machine main unit and a side fence.
Figure 6:
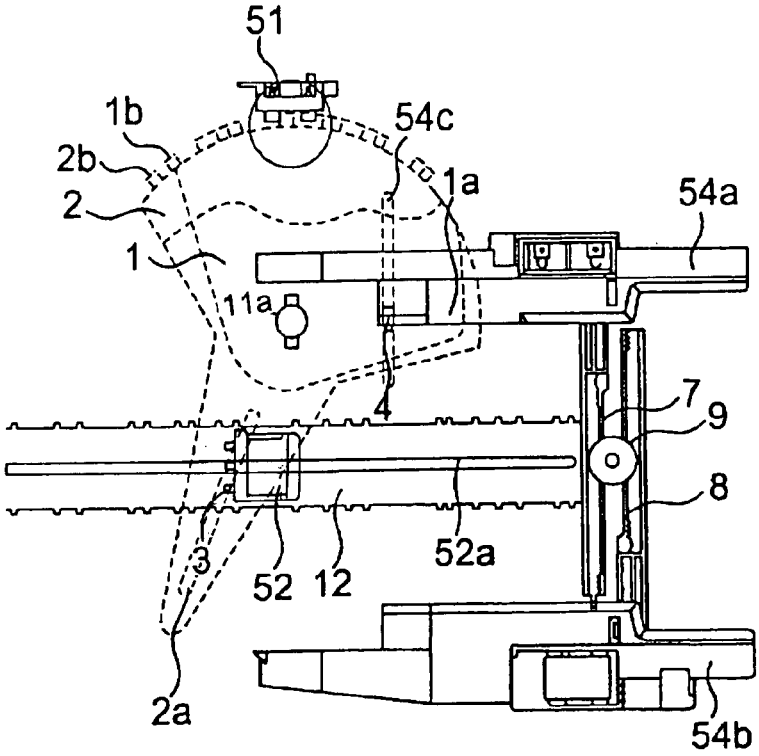
FIG. 6 is a plan view of a configuration of the paper size detecting device together with the side fence and an end fence.
Figure 7:
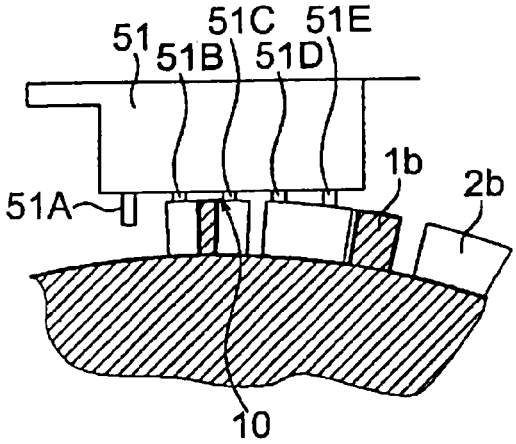
FIG. 7 is an explanatory diagram of a relationship between a corrugated portion formed at distal ends of first and second levers of the paper size detecting device and a detecting sensor.
Figure 8:
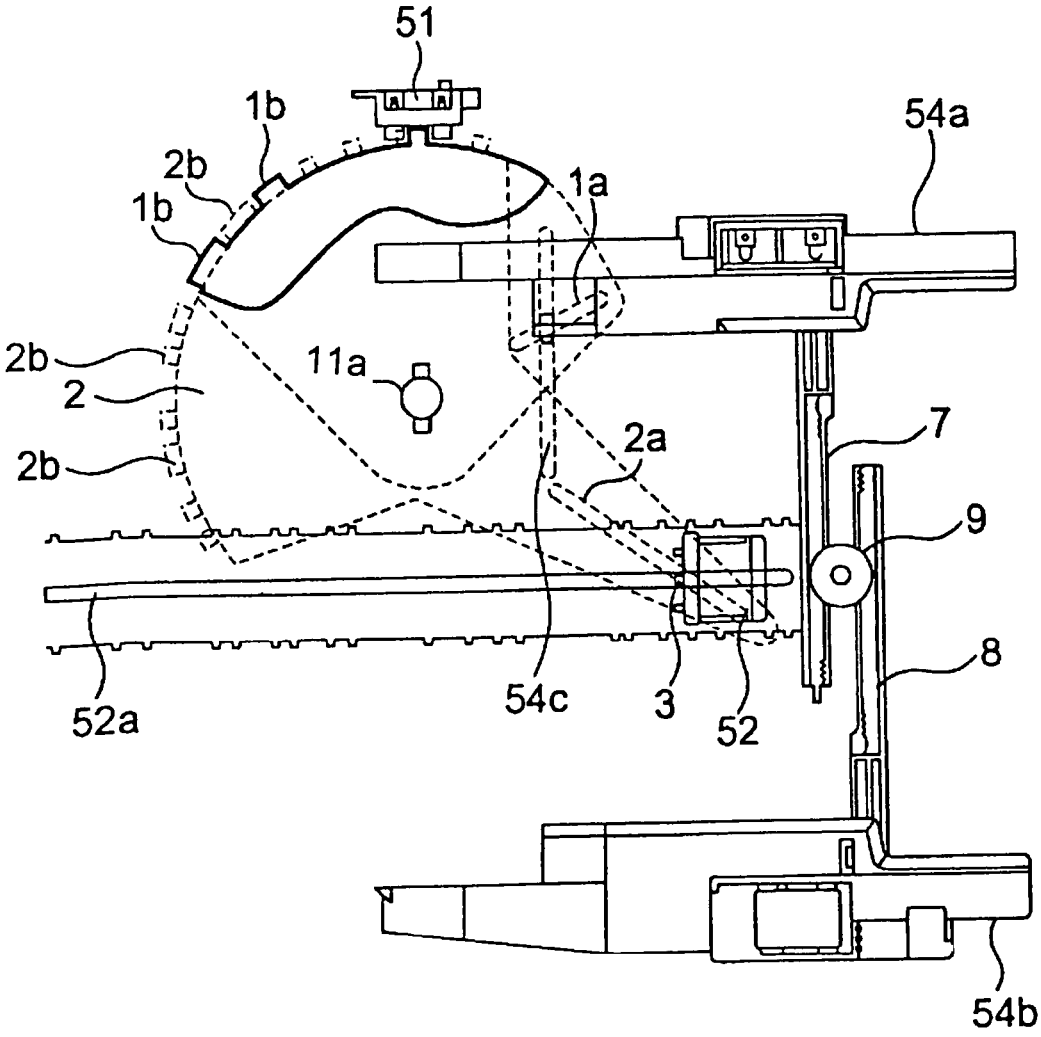
FIG. 8 depicts a position of the second lever when the end fence is placed at a position corresponding to a minimum paper size.
Figure 9:
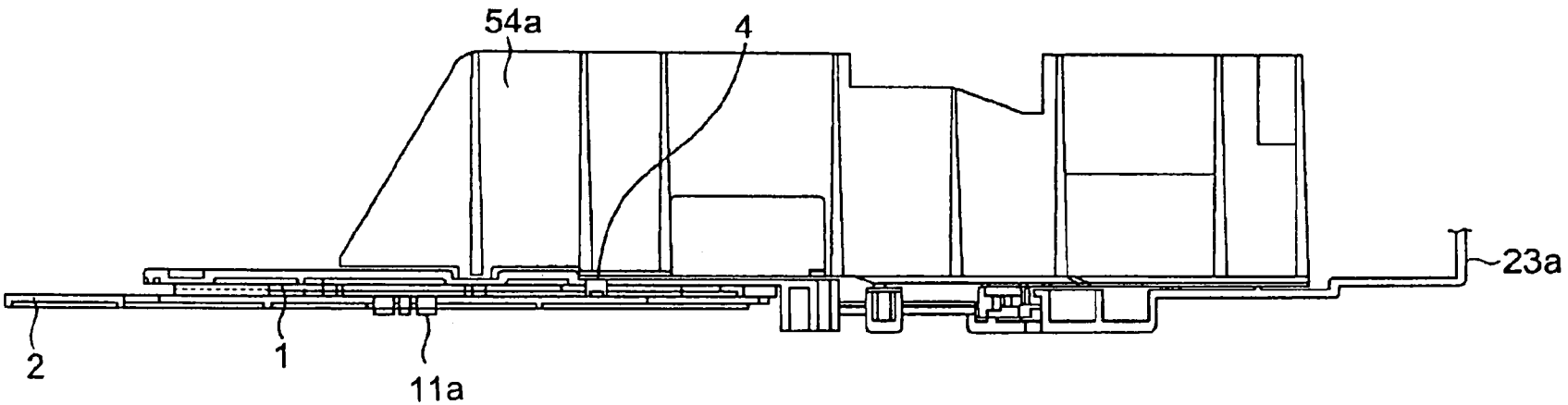
FIG. 9 is a side view of only the first and the second levers overlapped with the side fence.
Figures 10, 11:
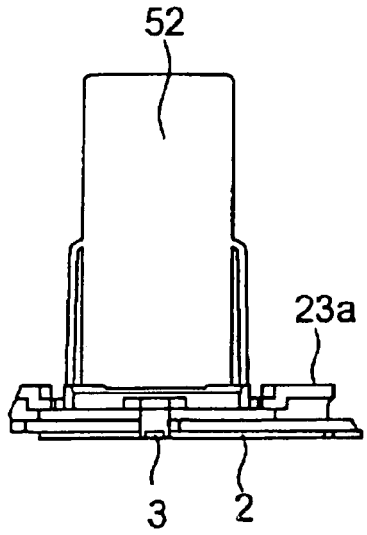
FIG. 10 is a side view of only the first and the second levers overlapped with the end fence.
FIG. 11 is a table of pattern combinations of paper sizes and first and second corrugated portions corresponding to the paper sizes.

Basic configuration of each paper feed tray 23 and the paper size detecting device will be explained with reference to FIGS. 3 to 10. FIG. 3 is a perspective view of the paper feed tray and a detecting sensor, FIG. 4 is a plan view of the paper feed tray positioned at a loading position within the copying machine main unit and the detecting sensor provided to a paper feed tray main unit, FIG. 5 is a plan view of a sliding mechanism of the paper feed tray positioned just before the loading position within the copying machine main unit and a side fence, FIG. 6 is a plan view of the configuration of the paper size detecting device together with the side fence and an end fence, FIG. 7 is an explanatory diagram of a relationship between corrugated portions formed at distal ends of first and second levers of the paper size detecting device and the detecting sensor, FIG. 8 depicts a position of the second lever when the end fence is placed at a position corresponding to the minimum paper size, FIG. 9 is a side view of only the side fence, and the first and the second levers, and FIG. 10 is a side view of only the end fence and the first and the second levers.

As shown in FIG. 3, the paper feed tray 23 has a box-like tray main unit 23*a* with an opened top, and a pair of side fences 54*a* and 54*b* and an end fence 52 are slidably provided on the tray main unit 23*a*. A direction orthogonal to a conveying direction of a paper 53 is restricted by the pair of slidable side fences 54*a* and 54*b*, and the conveying direction of the paper 53 is restricted by the slidable end fence 52. As shown in FIG. 5, the side fences 54*a* and 54*b* are coupled with racks 7 and 8 disposed on a back face side of a bottom of the tray main unit 23*a*. The racks 7 and 8 are coupled via a pinion gear 9, and the pair of side fences 54*a* and 54*b* are slid in directions in which they approximate to and separate from each other by the same distance by a rack and pinion mechanism. The end fence 52 is slid while being guided by an elongated hole 52*a* provided on the bottom of the tray main unit 23*a*.

Figure 4:
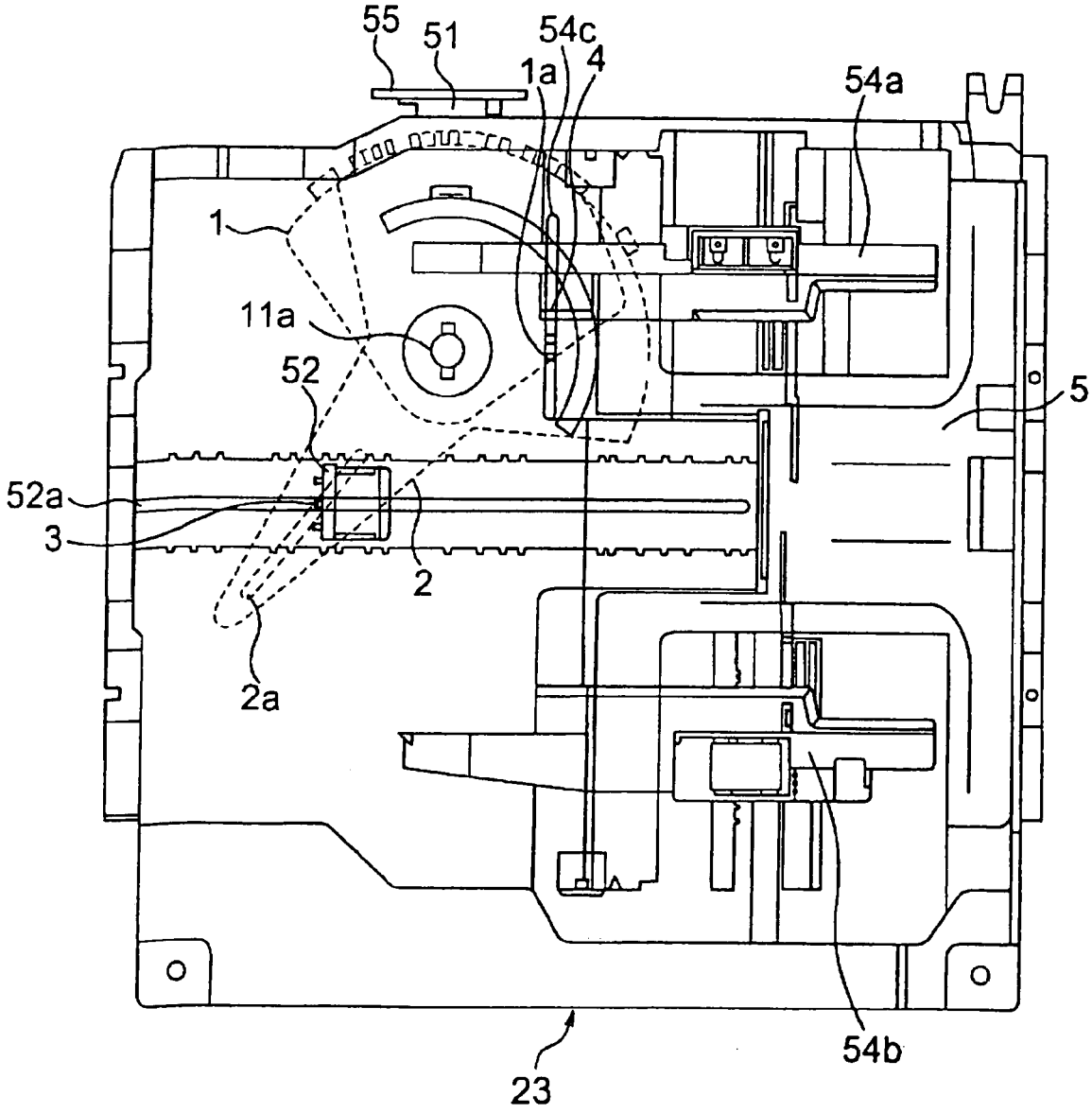
FIG. 4 is a plan view of the paper feed tray positioned at a loading position inside a copying machine main unit and the detecting sensor provided in a paper feed tray main unit.

As shown in FIG. 4, a bottom plate 5 that pushes up a leading edge side of stacked paper 53 in a paper feeding direction is provided at a portion of the bottom of the tray main unit 23*a*. A direction indicated by arrow 6 shown in FIG. 5 corresponds to a setting direction of the paper feed tray 23.

An end fence interlocking shaft 3 is provided on a lower portion of the end fence 52 to extend downwardly, and the end fence interlocking shaft 3 is suspended downwardly via the elongated hole 52*a*. A side fence interlocking shaft 4 is provided downwardly on a lower portion of the side fence 54*a* of the side fences 54*a* and 54*b* that is positioned on a depth side to the setting direction (direction of arrow 6). The side fence interlocking shaft 4 is suspended downwardly via an elongated hole 54*c*.

First and second levers 1 and 2 that are rotatably attached to a common supporting shaft 11 in an overlapping manner are provided on a lower portion of the bottom of the tray main unit 23*a*. The first lever 1 has a fan shape, and is formed with a guide elongated hole 1*a* in which the side fence interlocking shaft 4 is inserted with a clearance so as to be interlockingly rotated with sliding motion of the side fence 54*a*. The second lever 2 has an almost ginkgo leaf shape or fan shape, and is formed with a guide elongated hole 2*a* in which the end fence interlocking shaft 3 is inserted with a clearance so as to be interlockingly rotated with sliding motion of the end fence 52. The first and the second levers 1 and 2 have arc-shaped side edges set at the same distance from the center line of the supporting shaft 11. A first corrugated portion 1*b* is formed on the arc-shaped side edge of the first lever 1, while a second corrugated portion 2*b* is formed on the arc-shaped side edge of the second lever 2. The first and the second levers 1 and 2 are provided such that the corrugated portions 1*b* and 2*b* are positioned within an outer diametrical size of the tray main unit 23*a* at a leading end of the setting direction of the tray main unit 23*a*. Since the first and the second levers 1 and 2 are disposed in an overlapping manner, the first corrugated portion 1*b* of the first lever 1 and the second corrugated portion 2*b* of the second lever 2 are positioned in an overlapping manner, so that a plurality of composite corrugated portions can be formed by overlapping the first and the second corrugated portions 1*b* and 2*b* with each other with different angles.

As shown in FIG. 7, the detecting sensor 51 attached to a side plate 55 of the copying machine main unit 10 is provided with five push switches 51A, 51B, 51C, 51D, and 51E. When the paper feed tray 23 is set in the setting direction (direction of arrow 6) shown in FIG. 5, the composite corrugated portion constituted of the corrugated portions 1*b* and 2*b* of the first and the second levers 1 and 2 are brought in pressure contact with the detecting sensor 51, so that arbitrary ones of the push switches 51A, 51B, 51C, 51D, and 51E corresponding to projections of the composite corrugated portion are pushed to output ON signals, as shown in FIG. 7. The composite corrugated portion changes according to movements of the side fences 54*a* and 54*b*, and the end fence 52. Thus, two first and second levers 1 and 2 are pivoted in an overlapping manner, and a combination of the respective two corrugated portions 1*b* and 2*b* of the first and the second levers 1 and 2 forms a pattern for pressing the push switches of the detecting sensor 51.

FIG. 11 is a table showing paper sizes (Y corresponding to a lateral size and T corresponding to a longitudinal size) for respective destinations and ON/OFF states of the push switches of the detecting sensor 51 that are turned ON/OFF according to pattern combinations of the first and the second corrugated portions 1*b* and 2*b* at that time. "A" to "E" in the table shown in FIG. 11 denote the push switches 51A to 51E of the detecting sensor 51, and "0" denotes OFF (switch is not pressed: pattern corresponds to a recess), while "1" denotes ON (switch is pressed: pattern corresponds to a projection).

As shown in FIG. 7, it is difficult to make the corrugated portions 1*b* and 2*b* of the first and the second levers 1 and 2 always satisfy intervals among the push switches 51A to 51E of the detecting sensor 51. As shown with arrow 10, for example, an end portion of the corrugated pattern of the second lever 2 sometimes does not quite contact with the push switch 51C. In this case, however, since an interval formed in mass production is not an interval that can guarantee non-contact, a configuration in which the push switch 51C can be pressed by the corrugated pattern of the first lever 1, and the corrugated patterns of the two first and second levers 1 and 2 compliment one another, can be employed.

Figure 12:
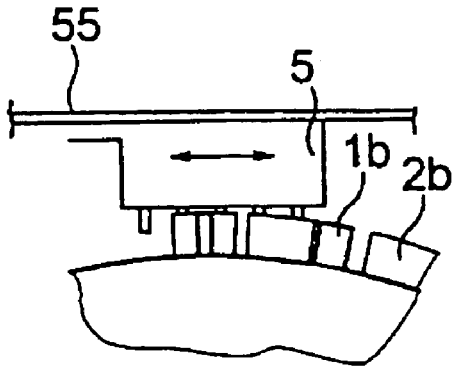
FIG. 12 is an explanatory diagram of occurrence of deviation in a mounting position of the detecting sensor.

On the other hand, as described above, when the detecting sensor 51 is attached to the side plate 55 of the copying machine main unit 10, as shown in FIG. 12, a positional deviation may occur due to low attaching accuracy of parts required when the detecting sensor 51 is attached to the side plate 55 or when the side plate 55 is attached to the copying machine main unit 10 so that a paper size cannot be detected accurately. For example, a first read rate (FRR) separation paper feeding device that separates sheets of paper in each paper feeding tray 23 from each other to convey them one by one, such as the one shown in FIG. 13, has the following problems.

Figure 13:
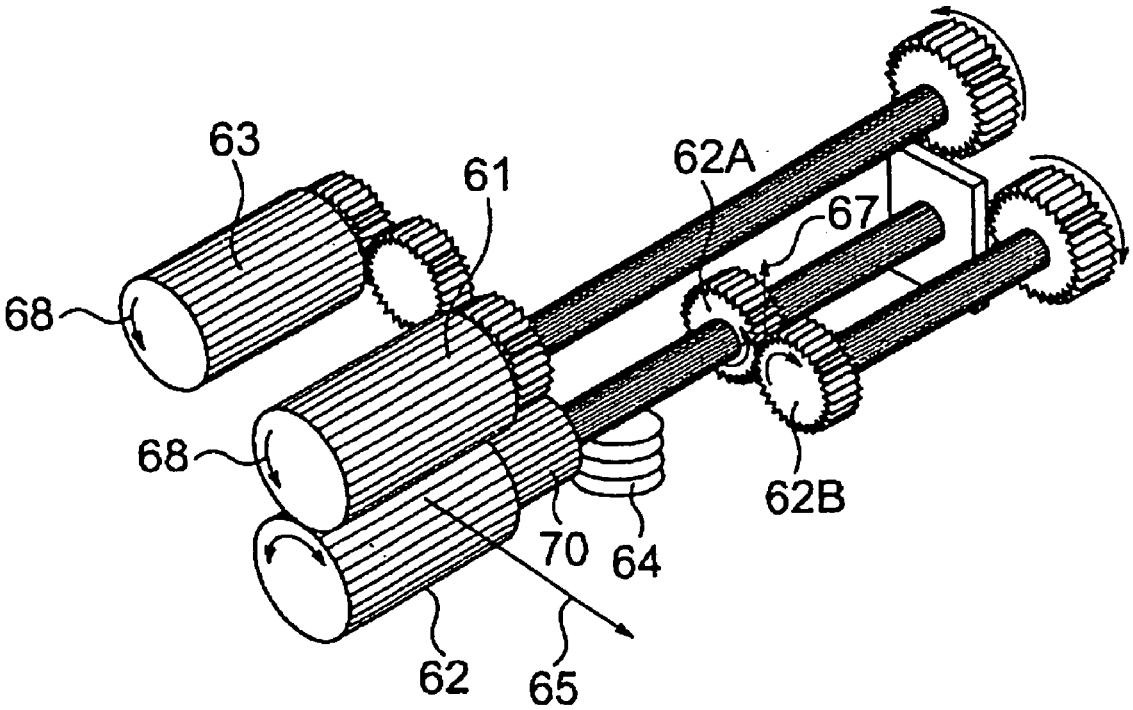
FIG. 13 is a perspective view of one example of a paper feeding apparatus that separates sheets of paper from one another to convey them one by one.

In the FRR separation paper feeding device that nips paper between a feed roller and a separating member brought in pressure contact with the feed roller to convey the paper separately, as shown in FIG. 13, paper is picked up from a paper stack (not shown) by a pickup roller 63 to be guided to a feed roller 61. The feed roller 61 rotated in a paper feeding direction shown with arrow 68 separates sheets of paper one by one from the paper stack in association with a reverse roller 62 that is applied with a predetermined torque in a direction reverse to the paper feeding direction by a torque limiter 70 to convey the sheets of paper one by one. A magnitude of the torque transmitted to the reverse roller 62 is limited by the torque limiter 70. That is, when a torque transmitted from a drive gear 62B to an idle gear 62A is larger than a predetermined magnitude, transmission of the torque is stopped, but when it is equal to or smaller than the predetermined magnitude, the torque is transmitted. Thus, for example, when two pieces of overlapped sheets of paper are fed out, the upper sheet of paper is fed in a direction of arrow 65, while the lower sheet of paper is returned back in a direction opposite to the arrow 65 by the reverse roller 62 shown in FIG. 13. This is because a frictional force between the two sheets is small, so that the reverse roller 62 is rotated according to rotation of the feed roller 61 rotated in the direction of the arrow 68 when one piece of paper is fed out. More specifically, the torque transmitted by the drive gear 62B is applied to the reverse roller 62 via the idle gear 62A provided on a shaft of the reverse roller 62 so as to mesh with the drive gear 62B and the reverse roller 62 brought in pressure contact with the feed roller 61 with a force of a resilient member (a spring 64 in this case) is driven by a gear tooth face pressure between the drive gear 62B and the idle gear 62A indicated by arrow 67 and an initial pressurizing force so that sheets of paper are separated and conveyed one by one.

In the above separating mechanism, accompanied-feeding or overlapped-feeding of sheets of paper due to close contact therebetween can be prevented by conducting separation by the reverse roller 62 until the paper passes through a nip between the feed roller 61 and the reverse roller 62. However, when the feed roller 61 is stopped and the reverse roller 62 is driven, a force acts in a direction reverse to a paper conveying direction due to load of the torque limiter 70 so that a slippage amount of paper increases. In order to avoid the increase in the slippage amount of paper, the feed roller 61 is driven, but unless the feed roller 61 is stopped before the paper passes through the nip, the next paper can be also fed as a copy paper. Therefore, the feed roller 61 is stopped before the first paper passes through the nip. If the feed roller 61 is stopped at an exact correct point, a time in which the feed roller 61 is driven is long, therefore, occurrence of slippage can be suppressed to the minimum. Accordingly, when a paper size is known accurately, paper can be conveyed highly accurately.

Figure 1:
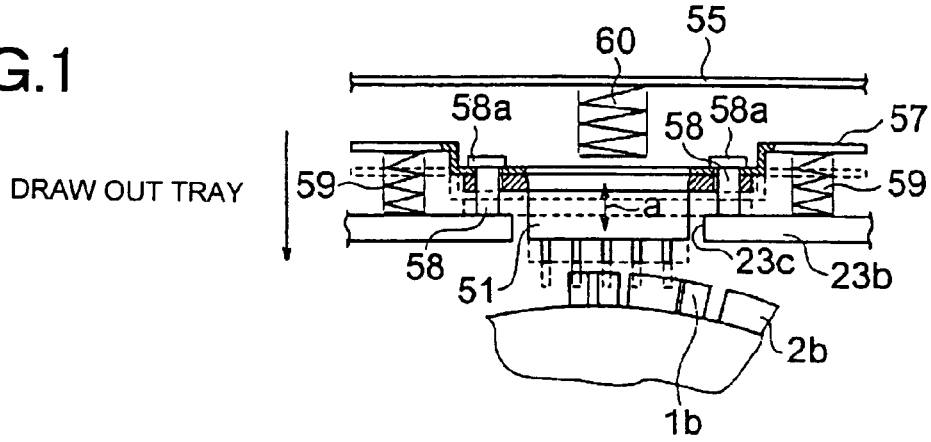
FIG. 1 is a plan view of a paper size detecting device of a paper feed tray according to an embodiment of the present invention, with the paper feed tray drawn out.
Figure 2:
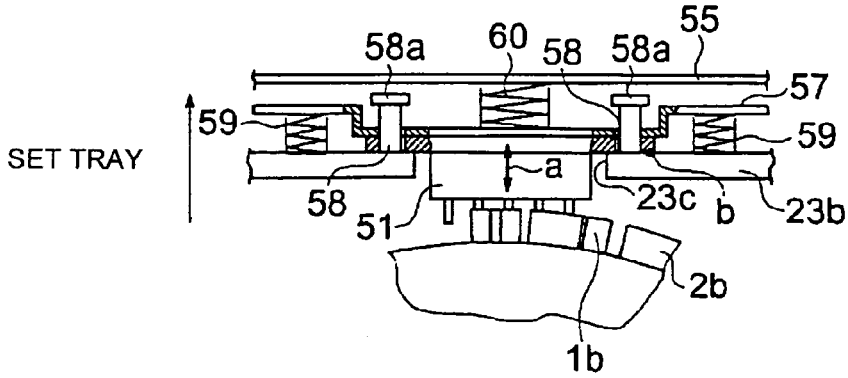
FIG. 2 is a plan view of the paper size detecting device according to the embodiment of the present invention, with the paper feed tray set.

The present invention improves accuracy in detection of paper sizes with less positional deviation. FIG. 1 is a plan view of the paper size detecting device corresponding to an improvement point in the invention, with the paper feed tray 23 drawn out. FIG. 2 is a plan view of the paper size detecting device, with the paper feed tray 23 set.

In the paper feed tray 23, the detecting sensor 51 is fixedly supported on a bracket 57. On the other hand, an opening 23*c* extending in a direction orthogonal to a setting direction of the paper feed tray 23, having a size into which the detecting sensor 51 can be inserted with a clearance, is formed in a side wall 23*b* at a depth position in the setting direction of the paper feed tray 23. Guide pins 58 are provided so as to correspond to both ends of the opening 23*c* in a longitudinal direction thereof substantially in a standing manner, and a bracket 57 is attached to the guide pins 58 to be slidable in a direction of arrow "a" such that the detecting sensor 51 faces the opening 23*c*. Pressurizing members 59 such as coil springs are respectively attached to both ends of the bracket 57 to bias the bracket 57 in a direction separating from the side wall 23*b* of the paper feed tray 23. The bracket 57 is positioned by stoppers 58*a* provided at distal ends of the guide pins 58. One end of a detecting sensor pressing member 60 such as a coil spring is fixed to the side plate 55 of the copying machine main unit 10, and the other end thereof presses the bracket 57 when the paper feed tray 23 is set. The detecting sensor 51 is electrically connected to the copying machine main unit 10 via a connector such as a drawer connector (not shown).

When the paper feed tray 23 is set to the copying machine, the bracket 57 is first pushed toward the side wall 23*b* of the paper feed tray 23 by the detecting sensor pressing member 60 to abut on the side wall 23*b* at a point "b", so that the detecting sensor 51 is positioned. The detecting sensor pressing member 60 can be formed of a resilient body such as a leaf spring and it is constituted so as to accommodate a positional relationship between the side plate 55 of the copying machine main unit 10 and the paper feed tray 23. With this configuration, distances to distal ends of the first and the second levers 1 and 2 can be set accurately. Accurate positioning with respect to lateral deviation shown in FIG. 12 is possible by the guide pins 58. Furthermore, when the paper feed tray 23 is drawn out, since the detecting sensor 51 is interlockingly separated from the first and the second levers 1 and 2 with the drawing-out operation, contact between the first and the second levers 1 and 2 and the detecting sensor 51 can be reliably prevented even at a time of setting sheets of paper.

According to the present invention, since the paper size detector that detects a size of the paper set is provided integrally with the paper feed tray, the paper size can be detected with a higher accuracy.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper feed tray comprising:

a tray unit configured to accommodate a stack of recording mediums;

a first aligning unit slidable in a first direction and that is configured to perform an alignment of the stack of the recording mediums in the tray unit in the first direction;

a second aligning unit slidable in a second direction that is orthogonal to the first direction and that is configured to perform an alignment of the stack of the recording media in the tray unit in the second direction;

a first movable member including a first corrugated portion, and configured to pivot with respect to the tray unit according to sliding motion of the first aligning unit;

a second movable member including a second corrugated portion, and configured to pivot with respect to the tray unit according to sliding motion of the second aligning unit, the first corrugated portion and the second corrugated portion making a composite corrugated portion such that the first corrugated portion and the second corrugated portion overlap as seen along an axis of rotation of the first movable member such that the first corrugated portion outer diameter is congruent to the second corrugated portion outer diameter, and the composite corrugated portion is defined by both movements of the first movable member and the second movable member, which are moved by both sliding movements of the first aligning unit and sliding movements of the second aligning unit, respectively, so that the composite corrugated portion represents a size of the stack of recording mediums; and a detecting unit that has a plurality of actuatable portions configured to be selectively actuated by the composite corrugated portion so that the detecting unit detects the size of the stack of recording mediums.

2. The paper feed tray according to claim 1, further comprising a supporting member that resiliently supports the detecting unit in a direction in which the detecting unit extends from the tray unit, wherein when the paper feed tray is loaded in an apparatus, the detecting unit together with the supporting member is moved toward the composite corrugated portion.

3. The paper feed tray according to claim 2, wherein, when the paper feed tray is loaded in the apparatus, the actuatable portions of the detecting unit are selectively actuated by the composite corrugated portion.

4. The paper feed tray according to claim 1, wherein the first movable member and the second movable member are respectively constituted of plate shaped members, and are disposed on a bottom back face of the tray unit parallel to a surface of the tray unit on which the stack of the recording mediums is placed.

5. The paper feed tray according to claim 1, wherein the first movable member and the second movable member are attached concentrically.

6. The paper feed tray according to claim 1, wherein an axis of rotation of the first movable member and an axis of rotation of the second movable member are coaxial.

7. A paper feeding apparatus comprising:

a paper feed tray including:

a tray unit configured to accommodate a stack of recording mediums;

a first aligning unit slidable in a first direction and that is configured to perform an alignment of the stack of the recording mediums in the tray unit in the first direction;

a second aligning unit slidable in a second direction that is orthogonal to the first direction and that is configured to perform an alignment of the stack of the recording media in the tray unit in the second direction;

a first movable member including a first corrugated portion, and configured to pivot with respect to the tray unit according to sliding motion of the first aligning unit;

a second movable member including a second corrugated portion, and configured to pivot with respect to the tray unit according to sliding motion of the second aligning unit, the first corrugated portion and the second corrugated portion making a composite corrugated portion such that the first corrugated portion and the second corrugated portion overlap as seen along an axis of rotation of the first movable member such that the first corrugated portion outer diameter is congruent to the second corrugated portion outer diameter, and the composite corrugated portion is defined by both movements of the first movable member and the second movable member, which are moved by both sliding movements of the first aligning unit and sliding movements of the second aligning unit, respectively, so that the composite corrugated portion represents a size of the stack of recording mediums; and a detecting unit that has a plurality of actuatable portions which are selectively actuated by the composite corrugated portion so that the detecting unit detects the size of the stack of recording mediums; and a feeding unit configured to pick-up at least one recording medium from the tray unit and feed the recording medium to another device.

8. An image forming apparatus comprising:

an image forming unit configured to form an image on a recording medium based on an input image data;

a paper feed tray including:

a tray unit configured to accommodate a stack of recording mediums;

a first aligning unit slidable in a first direction and that is configured to perform an alignment of the stack of the recording mediums in the tray unit in the first direction;

a second aligning unit slidable in a second direction that is orthogonal to the first direction and that is configured to perform an alignment of the stack of the recording media in the tray unit in the second direction;

a first movable member including a first corrugated portion, and configured to pivot with respect to the tray unit according to sliding motion of the first aligning unit;

a second movable member including a second corrugated portion, and configured to pivot with respect to the tray unit according to sliding motion of the second aligning unit, the first corrugated portion and the second corrugated portion making a composite corrugated portion such that the first corrugated portion and the second corrugated portion overlap as seen along an axis of rotation of the first movable member such that the first corrugated portion outer diameter is congruent to the second corrugated portion outer diameter, and the composite corrugated portion is defined by both movements of the first movable member and the second movable member, which are moved by both sliding movements of the first aligning unit and sliding movements of the second aligning unit, respectively, so that the composite corrugated portion represents a size of the stack of recording mediums; and a detecting unit that has a plurality of actuatable portions which are selectively actuated by the composite corrugated portion so that the detecting unit detects the size of the stack of recording mediums; and a feeding unit configured to pick-up at least one recording medium from the tray unit and feed the recording medium to the image forming unit.

* * * * *